United States Patent [19]

Adolfsson

[11] Patent Number: 4,616,755

[45] Date of Patent: Oct. 14, 1986

[54] MEANS FOR WALL BOARDS

[75] Inventor: Roger Adolfsson, Stockholm, Sweden

[73] Assignee: Cederroths AB, Sweden

[21] Appl. No.: 607,150

[22] Filed: May 4, 1984

Related U.S. Application Data

[63] Continuation of Ser. No. 386,023, Jun. 7, 1982.

[51] Int. Cl.[4] ..... A47F 5/08

[52] U.S. Cl. ..... 211/89; 211/50

[58] Field of Search ..... 211/89, 10, 50, 87, 211/88; 206/387, 527; 248/316.3; 312/284

[56] References Cited

U.S. PATENT DOCUMENTS

| | | | |
|---|---|---|---|
| 2,762,597 | 9/1956 | Jaworski | 248/300 |
| 2,883,061 | 4/1959 | Moore | 211/89 X |
| 3,341,026 | 9/1967 | Spitler | 211/88 |
| 3,516,634 | 6/1970 | Salava et al. | 211/87 X |
| 4,132,311 | 1/1979 | Glinert | 206/387 |
| 4,182,455 | 1/1980 | Zurawin | 211/89 X |
| 4,304,382 | 12/1981 | Jelen | 211/89 X |
| 4,307,809 | 12/1981 | Haswell | 206/387 X |

FOREIGN PATENT DOCUMENTS

| | | | |
|---|---|---|---|
| 2091692 | 8/1982 | United Kingdom | 206/387 |

*Primary Examiner*—Robert W. Gibson, Jr.
*Assistant Examiner*—Blair M. Johnson
*Attorney, Agent, or Firm*—Ostrolenk, Faber, Gerb & Soffen

[57] ABSTRACT

Board for hanging on a wall to enable articles to be easily accessible. The board has a number of pockets (7,8,9) designed with walls used to retain the articles in such a way that they can easily be removed with the thumb or two fingers.

10 Claims, 6 Drawing Figures

MEANS FOR WALL BOARDS

RELATED APPLICATIONS

This is a continuation of U.S. patent application Ser. No. 386,023, filed June 7, 1982.

BACKGROUND OF THE INVENTION

The present invention relates to a board for hanging on a wall to enable medical articles, for instance, to be placed so that they are easily visible and accessible, said articles being substantially rectangular or quadratic in shape.

Such boards can be used with advantage for the systematic arrangement of first-aid articles which can then be placed on the wall of workshop premises, offices, etc. The object of such a board is that in the event of an accident, suitable first-aid material is quickly available, as well as instructions as to the best way of dressing the injury. To this end, therefore, the products should be fully visible on the board and easy to remove therefrom, while at the same time being prevented from falling off the board.

First-aid materials for this purpose are usually kept in a wall cabinet and/or box but such methods of storage do not permit easy access and immediate visibility of the products required.

SUMMARY OF THE INVENTION

The above drawbacks and difficulties have now been solved in a surprising manner by means of the hanging board proposed according to the invention, with the features defined in the claims.

To facilitate removal of the products from the compartments, therefore, according to a preferred embodiment the outer walls converge towards the opening of the compartments.

With the object of improving the retention of the receiving compartment, the inner walls of the compartments may also converge in the direction of the compartment opening, or they may diverge slightly or be straight.

The compartment walls are preferably resilient for the receipt of relatively rigid products.

According to an alternatively embodiment, of course, the compartment walls may be relatively rigid in order to receive elastic products.

To facilitate removal of the products from the compartment spaces, the compartment walls are provided with notches to provide a grip for thumb or fingers.

According to another embodiment of the invention, the pockets may be in the form of separate parts which are secured to plates therefore on the board. Alternatively, the compartments can be produced by means of deep drawing the board itself.

According to yet another embodiment of the invention, in order to achieve improved retention in the compartment, the walls may be arranged in pairs parallel to each other and provided with engagement means, such as studs, for engagement with notches in the product to be retained, or vice versa.

In accordance with one embodiment of the present invention, the invention is directed toward a combination of:

(A) a board for displaying and releasably holding articles such as medical articles, said board comprising:

(1) a generally flat rear sheet having a shape which permits it to be hung on a wall;

(2) a plurality of compartments extending outwardly from a front surface of said sheet, each of said compartments being defined by a rear wall lying generally parallel to said rear sheet and four planar side walls extending from said rear wall in a direction generally perpendicular to the plane of said flat rear sheet and defining an open parallelepiped recess; and (B) at least one medical article, each said article being located in a respective said compartment, each said article having a shape which allows it to be snuggly received in its said respective said compartment, the rigidity of said side walls of each said compartment being greater than the rigidity of its respective said article such that each of said articles is elastically deformed by said side walls and is held in its said respective compartment by the friction force resulting from the compressive forces exerted on said rigid side walls of said respective compartment by the said elastically deformed article located therein, the depth of each of said articles as measured in a direction perpendicular to said rear surface being greater than the depth of its respective said compartment such that said articles extend outwardly from their respective compartments and can easily be grasped from a position in front of said compartment, the side walls of each said article contacting substantially the entire surface of said side walls of its respective compartment.

In accordance with the second embodiment of the invention, the invention comprises the combination of:

(A), an article holder having a generally planar rear wall and four planar side walls extending from said rear wall in a direction generally perpendicular to the plane of said rear wall so as to define an open parallelepiped recess; and (B) a medical article located in said recess, said article having a shape which allows it to be snuggly received in said recess, the rigidity of said side walls being greater than the rigidity of said article such that said article is elastically deformed by said side walls and is held in said recess by the friction force resulting from the compressive forces exerted on said rigid side walls of said recess by said elastically deformed article, the depth of said article as measured in a direction perpendicular to said rear wall being greater than the depth of said side walls such that said article extends outwardly from said recess and can be grasped from a position opposite the opening of said parallelepiped recess, the side walls of said article contacting substantially the entire surface of said side walls of said compartment.

BRIEF DESCRIPTION OF THE DRAWINGS

The invention will be described more fully in the following with reference to a number of embodiments shown in the accompanying drawings, in which.

DETAILED DESCRIPTION OF THE INVENTION

Figure 1:
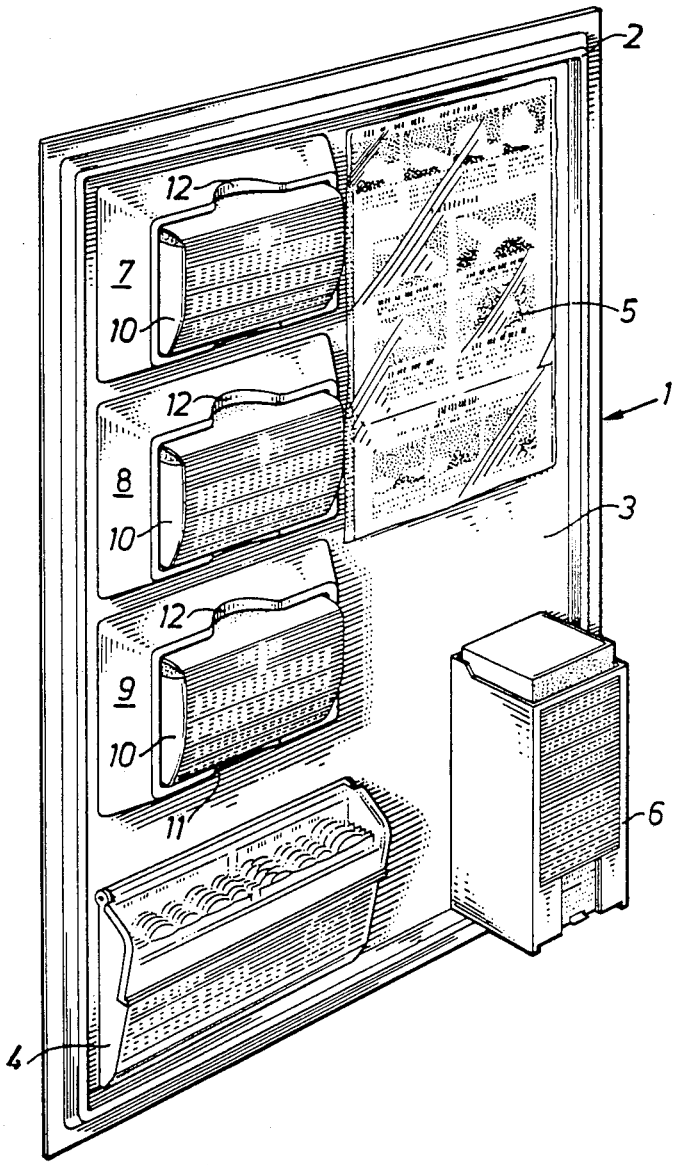
FIG. 1 is a perspective view of a wall board in accordance with the invention.

The board 1 shown in FIG. 1 comprises a sheet 3, preferably surrounded by frame. The sheet 3, preferably vacuum-moulded in plastic, is provided with means 4, 6, to carry various products, a space 5 for instructions in first-aid and compartments 7, 8 and 9 to receive the products 10 in question. In the example shown, three such compartments have been arranged, each defining a space limited by four walls, the outer surfaces converging towards the opening in the embodiment shown. Two of these walls, namely two opposite walls, are provided with recesses 11 and 12 located opposite each other and serving as finger grips so that the product in the compartment can easily be removed.

In the case of rigid products the walls should be somewhat resilient and in the case of soft products such as bandages, the walls should be relatively stiff, the inner surfaces of the walls defining the inner space of the compartments according to a suitable embodiment of the invention may also be slightly inclined, i.e. converging or slightly diverging towards the opening of the compartment. Of course, they may also be straight if so desired.

Figure 2:
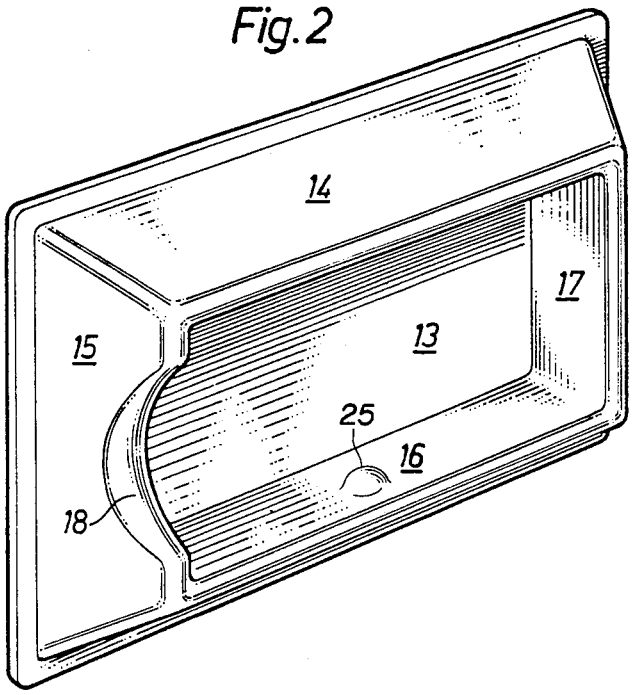
FIG. 2 is a front view of a compartment to be used on a wall board in accordance with the invention.
Figure 3:
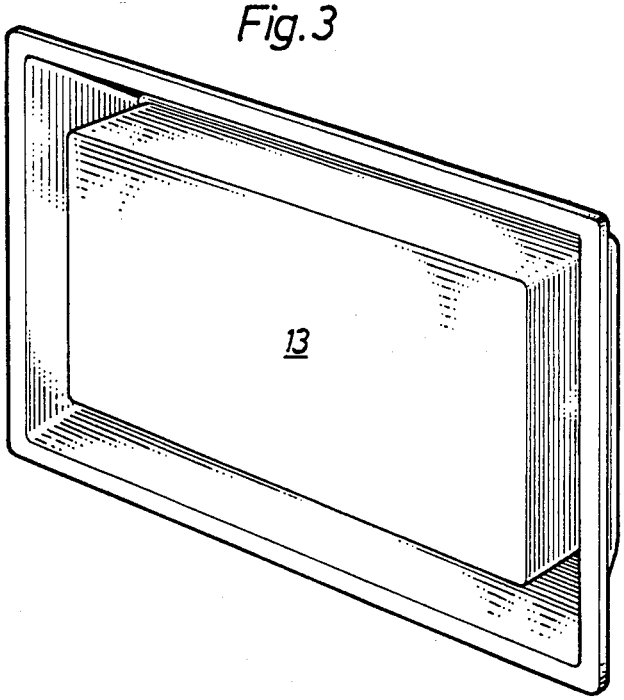
FIG. 3 shows the compartment according to FIG. 2 from the rear.

FIGS. 2 and 3 show an embodiment of the compartments 7, 8 and 9. In this case the compartment comprises a bottom 13 with four walls 14, 15, 16 and 17 projecting from this bottom 13 towards the opening of the compartment. One of the short walls, 15, in the rectangular compartment is provided with a recess 18 to provide a thumb grip. It should be evident how a product pressed into this compartment can be removed without special explanation.

Figure 4:
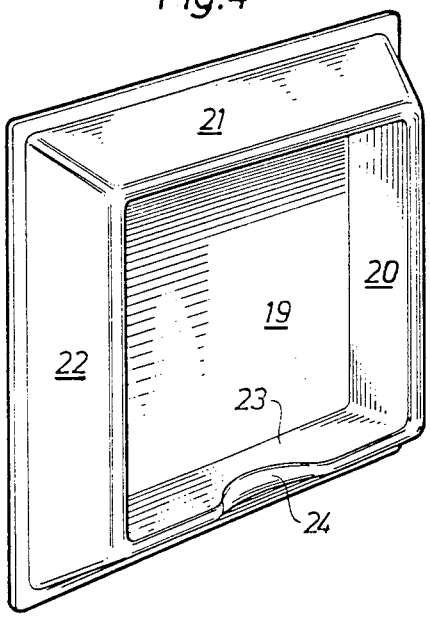
FIGS. 4 and 5 show a modified compartment seen from the front and the rear, respectively.
Figure 5:
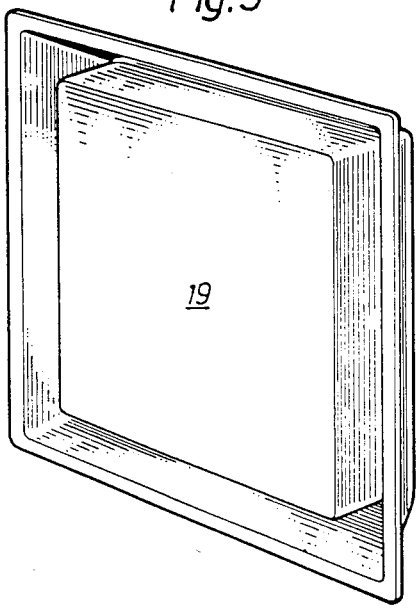

The compartment shown in FIGS. 4 and 5 similarly comprises a bottom 19 having four walls 20, 21, 22 and 23 framing it. In this case the compartment is square and its lower wall 23 is provided with the recess 24 serving as a thumb grip. No detailed explanation of the function should be necessary here either.

Figure 6:
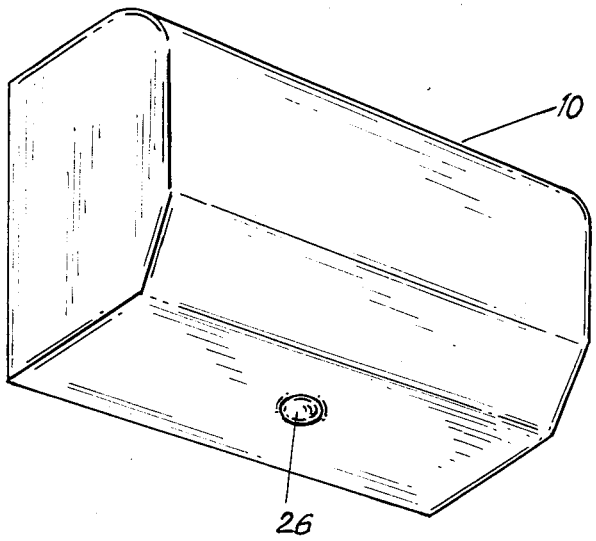
FIG. 6 is a schematic diagram of an article containing a recess which may be engaged by the projection in the side wall of the compartment of FIG. 2.

The invention is naturally not limited to the embodiments shown and described but can be varied in many ways within the scope of the following claims. For certain products, for instance, it is sufficient with only two opposing walls, in which case no thumb or finger grip is necessary. In other cases three walls might be suitable, the top wall being omitted. As a modification the walls might even be provided with a projection 25 (FIG. 2) for snapping into a recess 27 (FIG. 6) in the side of the products, or vice versa. However, this modification is probably only suitable for a few products. However, the compartments may be formed in the sheet itself or as separate parts to be secured to the flat board.

I claim:

1. In combination:

(A) a board for displaying and releasably holding articles such as medical articles, said board comprising:

(1) a generally flat rear sheet having a shape which permits it to be hung on a wall;

(2) a plurality of compartments extending outwardly from a front surface of said sheet, each of said compartments being defined by a rear wall lying generally parallel to said rear sheet and four smooth planar side walls extending from said rear wall in a direction generally perpendicular to the plane of said flat rear sheet and defining an open parallelepiped recess; and (B) at least one medical article, each said article being located in a respective said compartment, each said article having a shape which allows it to be snuggly received in its said respective said compartment, the rigidity of said side walls of each said compartment being greater than the rigidity of its respective said article such that each of said articles is elastically deformed by said side walls and is held in its said respective compartment by the friction force resulting from the compressive forces exerted on said rigid side walls of said respective compartment by the said elastically deformed article located therein, the depth of each of said article as measured in a direction perpendicular to said rear surface being greater than the depth of its respective said compartment such that said articles extend outwardly from their respective compartments along substantially the entire periphery of it's respective compartments and can easily be grasped from a position in front of said compartment, the side walls of each said article contacting substantially the entire surface of said side walls of its respective compartment.

2. The combination of claim 1, wherein at least one side wall of each of said compartments has a notch formed therein having a size and shape which will permit the said article located in that compartment to be gripped by a thumb or finger of an individual removing said article from said compartment.

3. The combination of claim 1, wherein each of said compartments are formed by a deep drawing operation.

4. The combination of claim 1, further including a respective projection formed in a side wall of each of said compartments and engaging a corresponding detent in said article located in said compartment.

5. The combination of claim 1, wherein each of said articles is substantially identical to the shape of the parallelepiped recess defined by the compartment associated with said article and the size of each of said articles is slightly greater than the size of the parallelepiped recess defined by the compartment associated with said article.

6. In combination:

(A) an article holder having a generally planar rear wall and four planar side walls extending from said rear wall in a wall so as to define an open parallelepiped recess; and (B) a medical article located in said recess, said article having a shape which allows it to be snuggly received in said recess, the rigidity of said side walls being greater than the rigidity of said article such that said article is elastically deformed by said side walls and is held in said recess by the friction force resulting from the compressive forces exerted on said rigid side walls of said recess along substantially the entire periphery of said recess by said elastically deformed article, the depth of said article as measured in a direction perpendicular to said rear wall being greater than the depth of said side walls such that said article extends outwardly from said recess and can be grasped from a position opposite the opening of said parallelepiped recess, the side walls of said article contacting substantially the entire surface of said side walls of said compartment.

7. The combination of claim 6, wherein the shape of said article is substantially identical to the shape of said parallelepiped recess and the size of said article is slightly greater than the size of said recess.

8. The combination of claim 6, wherein at least one side wall of said compartment has a notch formed therein having a size and shape which permits said article to be gripped by a thumb or finger of an individual removing said article from said compartment.

9. The combination of claim 6, wherein said compartment is formed by a deep drawing operation.

10. The combination of claim 6, further including a projection formed on a side wall of said compartment and engaging a corresponding detent in said article.

* * * * *